US006145350A

United States Patent [19]

Hwang

[11] Patent Number: 6,145,350

[45] Date of Patent: Nov. 14, 2000

[54] WASHING MACHINE HAVING SUB-PULSATOR

[75] Inventor: Jin-sung Hwang, Anyang, Rep. of Korea

[73] Assignee: SamSung Electronics Co., Ltd., Suwon, Rep. of Korea

[21] Appl. No.: 09/277,958

[22] Filed: Mar. 29, 1999

[30] Foreign Application Priority Data

Jun. 22, 1998 [KR] Rep. of Korea ..... 98-10859

[51] Int. Cl.[7] ..... D06F 17/08

[52] U.S. Cl. ..... 68/18 F; 68/53; 68/134

[58] Field of Search ..... 68/18 F, 53, 131, 68/134; 366/280; 416/171

[56] References Cited

U.S. PATENT DOCUMENTS 5,794,633 8/1998 Song ..... 68/53 X

FOREIGN PATENT DOCUMENTS 1039416 5/1953 France ..... 68/131

*Primary Examiner*—Philip R. Coe
*Attorney, Agent, or Firm*—Robert E. Bushnell, Esq.

[57] ABSTRACT

A washing machine having a sub-pulsator, the washing machine including a pulsator rotating in the left/right directions by a driving source during the washing process and guide duct mounted in a wash/spin-dry tub for guiding the washing water agitated by left/right rotations of the pulsator to the upper side of the wash/spin-dry tub, wherein the washing machine comprises:

a hydraulic turbine disposed in the guide duct; and a sub-pulsator arranged in the wash/spin-dry tub to mesh with the hydraulic turbine, such that a side water current is formed at an intermediate section of the wash/spin-dry tub without recourse to input of separately added power to thereby improve the washing performance.

14 Claims, 7 Drawing Sheets

WASHING MACHINE HAVING SUB-PULSATOR

CLAIM OF PRIORITY

This application makes reference to, incorporates the same herein, and claims all rights accruing thereto under 35 U.S.C. § 121 through my patent application entitled WASHING MACHINE HAVING SUB-PULSATOR earlier filed in the Korean Industrial Property Office on the 22$^{nd}$ day of June 1998 and there duly assigned Ser. No. 1998/10859.

BACKGROUND OF THE INVENTION

1. Field of the Invention

The present invention relates to a washing machine, and more particularly to a washing machine having a sub-pulsator.

2. Description of the Prior Art

Generally, a conventional washing machine is disposed with a body 1, an outer tub 3 mounted in the body 1, a wash/spin-dry tub 5 and a pulsator 7 arranged on an inner floor of the wash/spin-dry tub 5, as illustrated in FIG. 1.

The wash/spin-dry tub 5 is provided therein with a guide duct 9 for guiding the washing water ejected by the pulsator 7 and the guide duct 9 is coupled thereon with a filtering net 10 for filtering laundry residue contained in the washing water.

In the conventional washing machine, the pulsator 7 is rotated in left/right directions in the wash/spin-dry tub 5 to make the flow of the washing water turbulent for application of force to the laundry and to thereafter perform agitation and washing.

The washing water agitated by a lower rib of the pulsator 7 during the washing process rides up on the guide duct 9 and drops to the wash/spin-dry tub 5, where the laundry residue and the like are filtered by the filtering net 10.

However, there is a problem in the conventional washing machine thus constructed in that power for driving the pulsator consumes the power for forming a water current to the washing water at the upper side of the pulsator and to power for forming a rising current in the guide duct, where the power for forming the rising current in the guide duct has almost nothing to do with formation of water current to the washing water, such that the powers are not used altogether effectively.

There is another problem in that although a strong water current is formed underneath the wash/spin-dry tub by the pulsator, water current is weak at the upper side of the wash/spin-dry tub, thereby making the overall washing ineffective.

SUMMARY OF THE INVENTION

The present invention is disclosed to solve the aforementioned problems and it is an object of the present invention to provide a washing machine having a sub-pulsator adapted to effectively use power to thereby improve the washing efficiency.

In accordance with the object of the present invention, there is provided a washing machine having a sub-pulsator, the washing machine including a pulsator rotating in the left/right directions by a driving source during the washing process and guide duct mounted in a wash/spin-dry tub for guiding the washing water agitated by left/right rotations of the pulsator to the upper side of the wash/spin-dry tub, wherein the washing machine comprises:

a hydraulic turbine disposed in the guide duct; and a sub-pulsator arranged in the wash/spin-dry tub to mesh with the hydraulic turbine.

The hydraulic turbine is centrally equipped with vanes radially arranged from the center of the hydraulic turbine, and the vanes are mounted there outside with a guide rib for rotating the hydraulic turbine according to shock from the washing waster hitting thereto. The guide rib is coupled to the guide duct for part of rotating vanes to be exposed outside.

Furthermore, the hydraulic turbine is equipped with vanes so arranged as to each form a curvature having a radius growing larger as it is distanced from the center thereof. Each vane may be equipped there outside with a guide rib so as to rotate the hydraulic turbine according to counteraction of the washing water flowing by hitting the vanes. At this time, the guide rib encompasses the whole vanes and is coupled to the guide duct. A central axle member where the hydraulic turbine and the sub-pulsator are fixed is formed therein with a through hole through which the washing water raised through the guide duct is infused into the wash/spin-dry tub.

BRIEF DESCRIPTION OF THE DRAWINGS

For fuller understanding of the nature and object of the invention, reference should be made to the following detailed description taken in conjunction with the accompanying drawings in which.

DETAILED DESCRIPTION OF THE INVENTION

Preferred embodiments of the present invention will now be described in detail with reference to the accompanying drawings.

Figure 1:
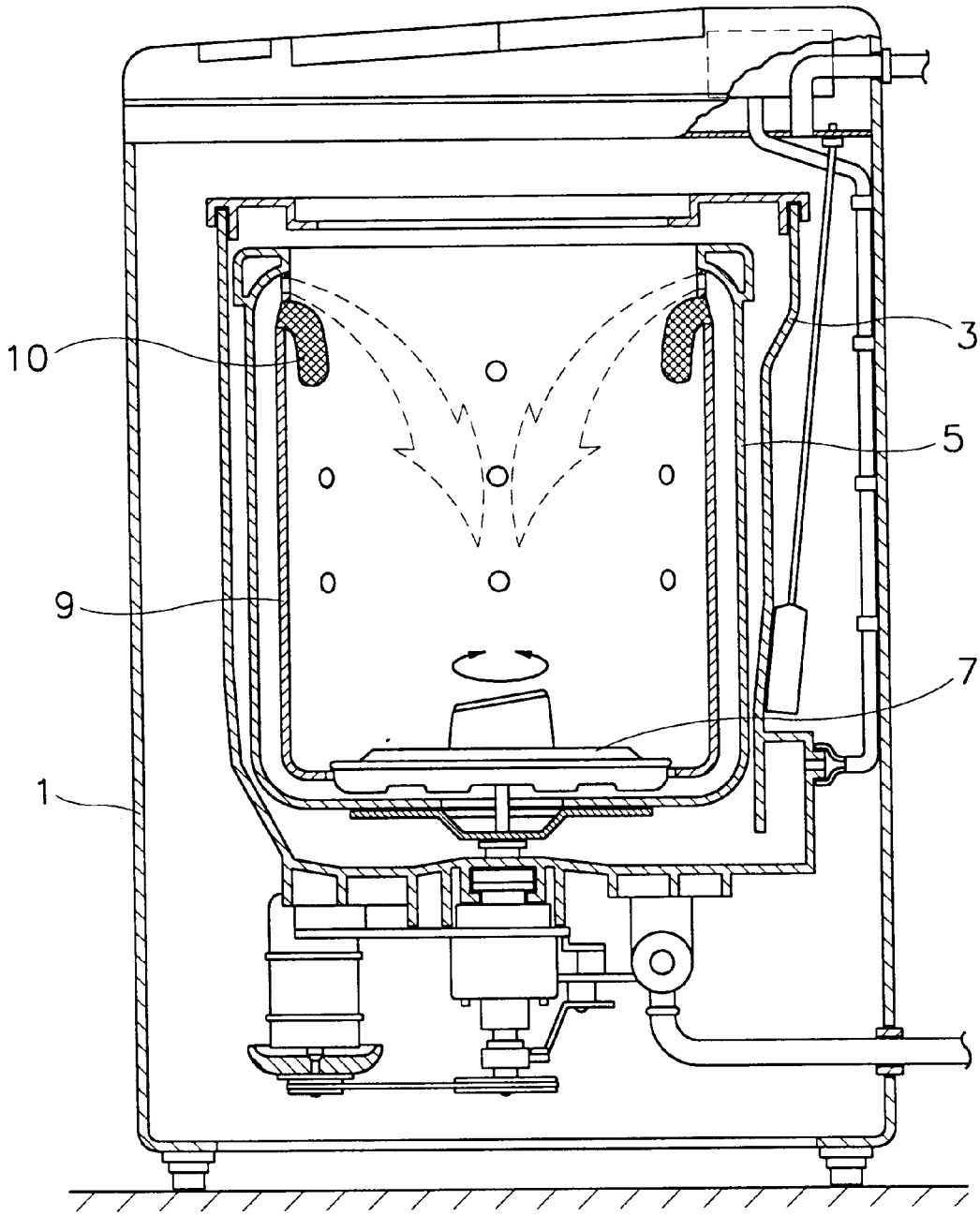
FIG.1 (PRIOR ART)
FIG. 1 is a longitudinal sectional view for illustrating a conventional washing machine.
Figure 2:
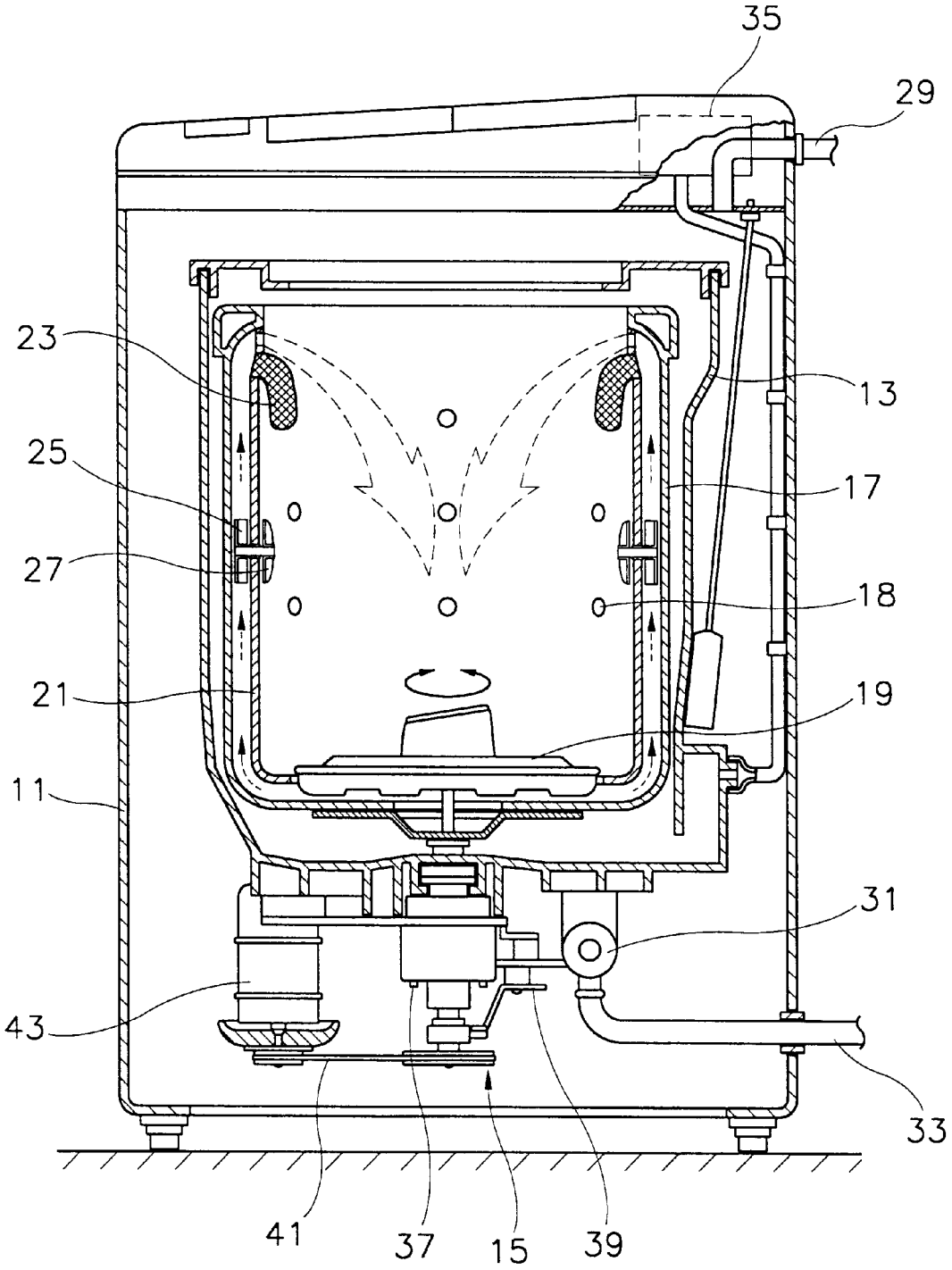
FIG. 2 is a longitudinal sectional view for illustrating a washing machine equipped with a sub-pulsator according to a first embodiment of the present invention.

FIG. 2 is a longitudinal sectional view for illustrating a washing machine equipped with a sub-pulsator according a first embodiment of the present invention. As illustrated in FIG. 2, the washing machine is disposed with a body 11, an outer tub 13 arranged in the body 11, a driving apparatus 15 provided underneath the outer tub 13 for driving the washing machine, a wash/spin-dry tub 17 mounted within the outer tub 13 for washing and spin-drying the laundry and a pulsator 19 equipped within the wash/spin tub 17 and coupled to a driving shaft of the driving apparatus 15 for rotating in the forward/reverse directions to thereby form a water current to the washing water.

The wash/spin-dry tub 17 is coupled therein with a guide duct 21 for guiding the washing water agitated by forward/ reverse rotations of the pulsator 19 upwards of the wash/spin-dry tub 17 and the guide duct 21 is coupled thereon to a filtering net 23 for filtering laundry residue contained in the rising washing water. Disposed in the guide duct 21 is a hydraulic turbine 25 and the wash/spin-dry tub 17 is mounted therein with a sub-pulsator 27 meshed to the hydraulic turbine 25. The sub-pulsator 27 is disposed near to the guide duct 21.

The body 11 is connected at the rear side thereof to a water supply hose 29 for supplying the washing water into the wash/spin-dry tub 17 from a faucet. The outer tub 13 is disposed thereunder with a drain pump 31 for discharging the washing water in the wash/spin-dry tub 17 and the drain pump 31 is connected to a drain hose 33 for discharging the washing water to a drainage (not shown).

Furthermore, the body 11 is mounted thereon with detergent dissolving means 35 for dissolving detergent by the supplied water to thereafter supply the dissolved detergent with the washing water into the outer tub 13 and the wash/spin-dry tub 17.

The driving apparatus 15 includes a speed reduction means 37 coupled to a driving shaft (spin-dry shaft and a washing shaft) for driving the wash/spin-dry tub 17 and the pulsator 19, power switch means 39 for cutting off the power transmitted to the spin-dry shaft during the washing process and for connecting the power transmitted to the spin-dry shaft during the spin-dry process, and a motor 43 for generating a power transmitted to the speed reduction means 37 via a belt pulley 41. The wash/spin-dry tub 17 is formed at a periphery thereof with a plurality of holes 18 for the washing water to pass.

Figure 3:
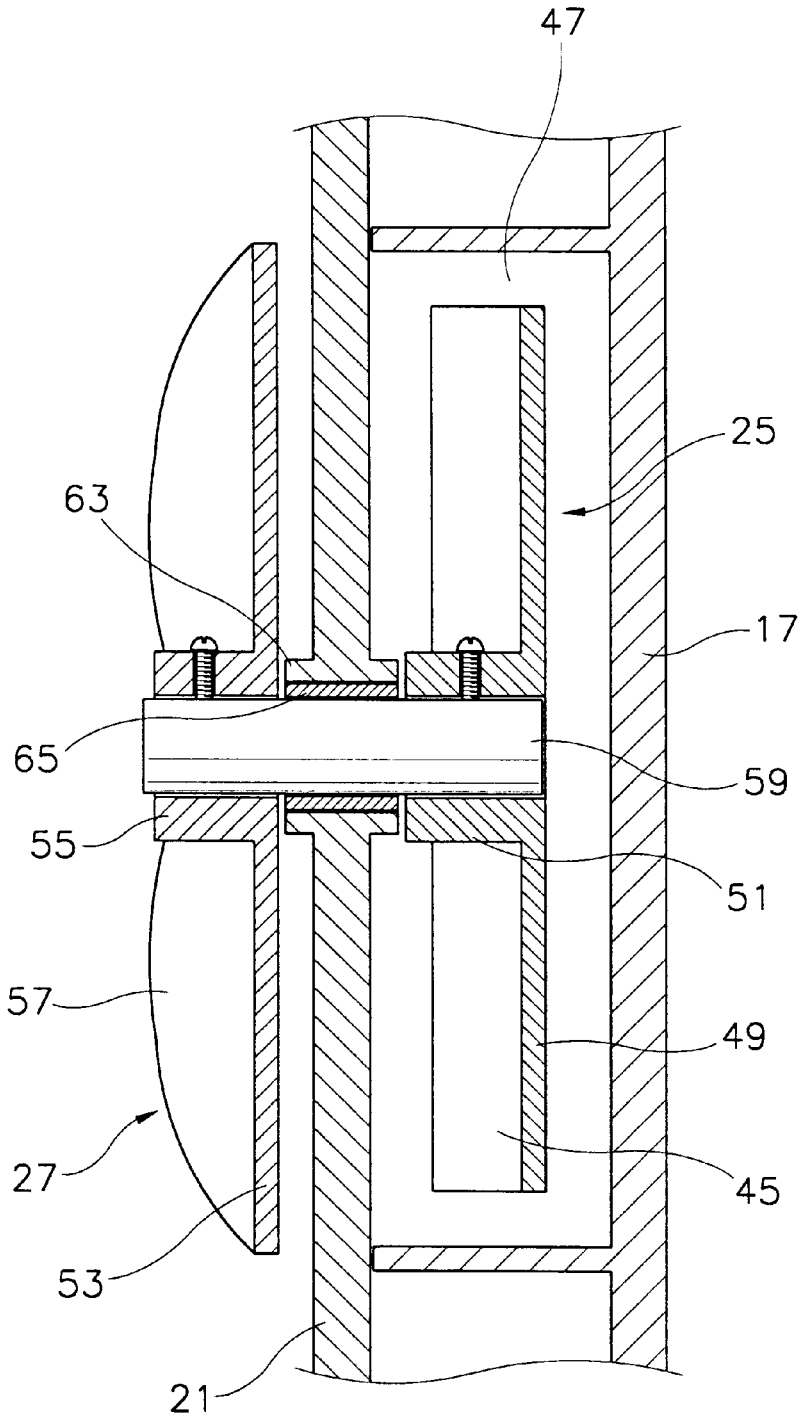
FIG. 3 is a longitudinal sectional view for illustrating a sub-pulsator in FIG. 2 and a hydraulic turbine coupled thereto.
Figure 4:
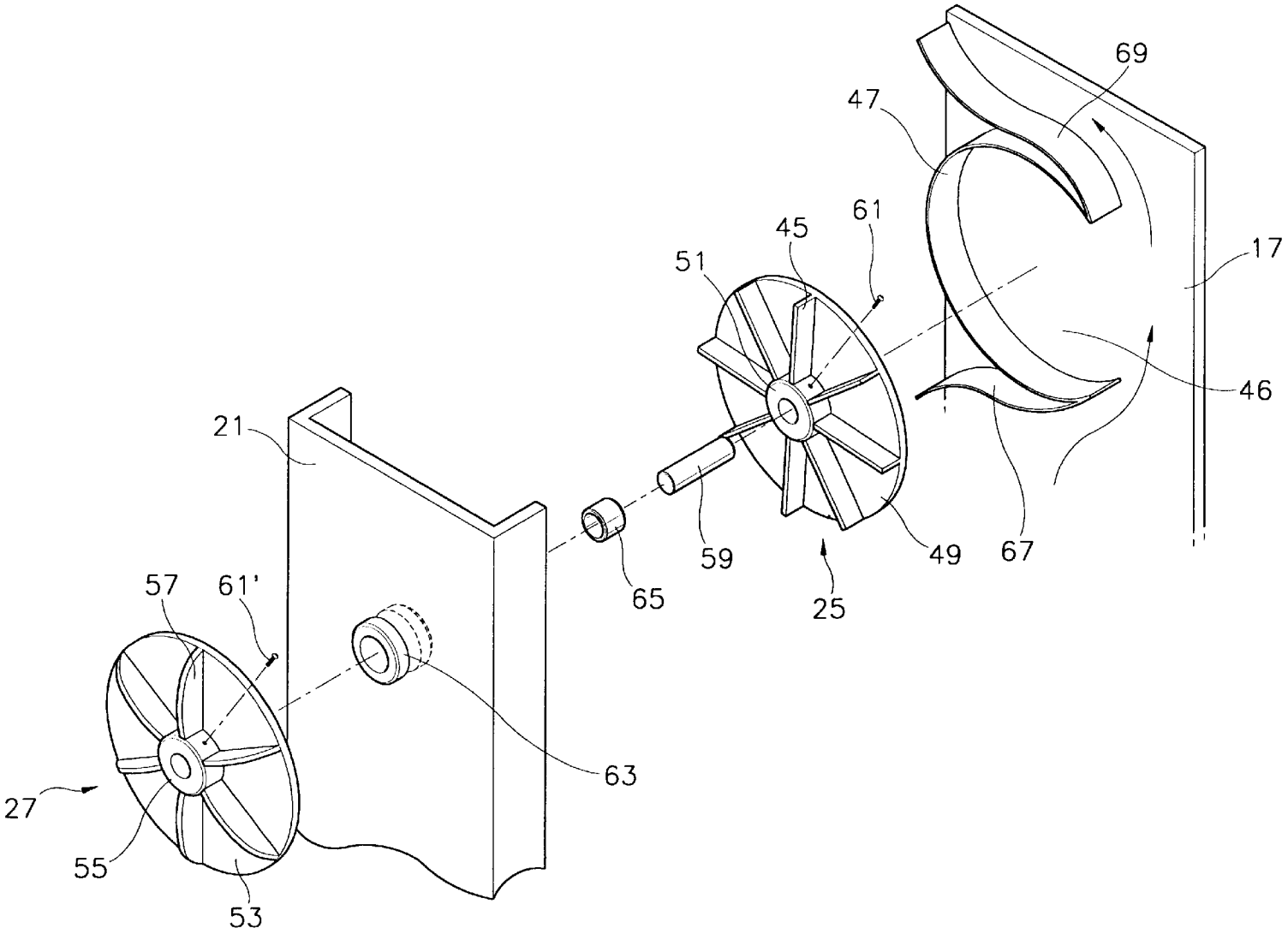
FIG. 4 is an exploded perspective view of FIG. 3.

As illustrated in FIGS. 3 and 4, the hydraulic turbine 25 is equipped with vanes 45 radially arranged from the center of the hydraulic turbine 25 and each hydraulic turbine is mounted with a guide rib 47 for rotating the hydraulic turbine according to shock of the washing water hitting the vanes 45. The guide rib 47, being equipped with an opening unit 46 for allowing part of rotating vanes to be exposed outside, is coupled to an inner space between the guide duct 21 and the wash/spin-dry tub 17.

The hydraulic turbine 25 includes a boss unit 51 centrally formed at a disc unit 49 and ribs outwardly formed from the boss unit 51 to thereby function as vanes 45.

The sub-pulsator 27 is also formed just like the hydraulic turbine in shape. In other words, the sub-pulsator 27 includes a boss unit 55 centrally formed at a disc unit 53 and ribs outwardly formed from the boss unit 55 to thereby function as vanes 57.

Both ends of shaft member 59 piercing the guide duct 21 are inserted into boss units 51 and 55 and fixed by fastening members 61 and 61' to thereby combine the hydraulic turbine 25 and the sub-pulsator 27. The guide duct 21 is formed with a protruder 63 in order to enlarge a slippage area of the shaft member 59 and is inserted thereinto by a bush 65 in order to smooth rotation of the shaft member 59. The guide rib 47 is coupled thereunder to a lower guide rib 67 for guiding the washing water to the opening unit 46 and is also coupled thereon to an upper guide rib 59 for guiding the washing water output from the opening unit 46 toward the filtering net.

In the washing machine equipped with a sub-pulsator according to the first embodiment of the present invention thus constructed, when a desired washing condition is selected and a power is applied during the washing process, washing water of predetermined quantity is supplied to the wash/spin-dry tub 17 and when the washing water is completed in supplying the wash/spin-dry tub 17, the motor 43 begins to operate.

Turning effect of the motor 43 is transmitted to the driving apparatus 15 via the belt 41, reduced in speed by the speed reduction means 37 and transmitted to the washing shaft to thereafter rotate the pulsator 19.

Upper side of the pulsator 19 makes the washing water in the wash/spin-dry tub 17 form a water current to thereby perform the washing. At this time, part of the stored washing water rides an inner passage of the guide duct 21 according to rib unit formed underneath the pulsator 19 and rises up as illustrated in a dotted arrow in FIG. 2.

The washing water raised along the inner passage of the guide duct 21 is guided according to the lower guide rib 67 and introduced into the opening unit 46 at the guide rib 47 and applies a shock to peripheries of the vanes 45 at the hydraulic turbine 45 to thereby rotate the hydraulic turbine 25.

Successively, the sub-pulsator 27 disposed within the wash/spin-dry tub 17 by being connected to the hydraulic turbine 25 is rotated to form a water current in the wash/spin-dry tub 17, such that the water current of the washing machine is strengthened under the same power.

The washing water which has rotated the hydraulic turbine 25 is guided by the upper guide rib 69 to further rise up and pass the filtering net 23, and drops into the wash/spin-dry tub 17.

When the washing process is performed as mentioned above and the washing is completed after a predetermined period of time, the washing water is drained out, rinsing process is performed several times and spin-dry process starts.

During the spin-dry process, the spin-dry shaft is rotated by operation of the power switch means 39 to rotate the wash/spin-dry tub 17 at a high speed for performance of spin-drying.

Meanwhile, water contained in the laundry which is leaned to an inner side of the wash/spin-dry tub 17 by centrifugal force generated by rotation of the wash/spin-dry tub 17 is discharged through the hole 18, stored in the outer tub 13 and is drained out along the drainage hose.

Figure 5:
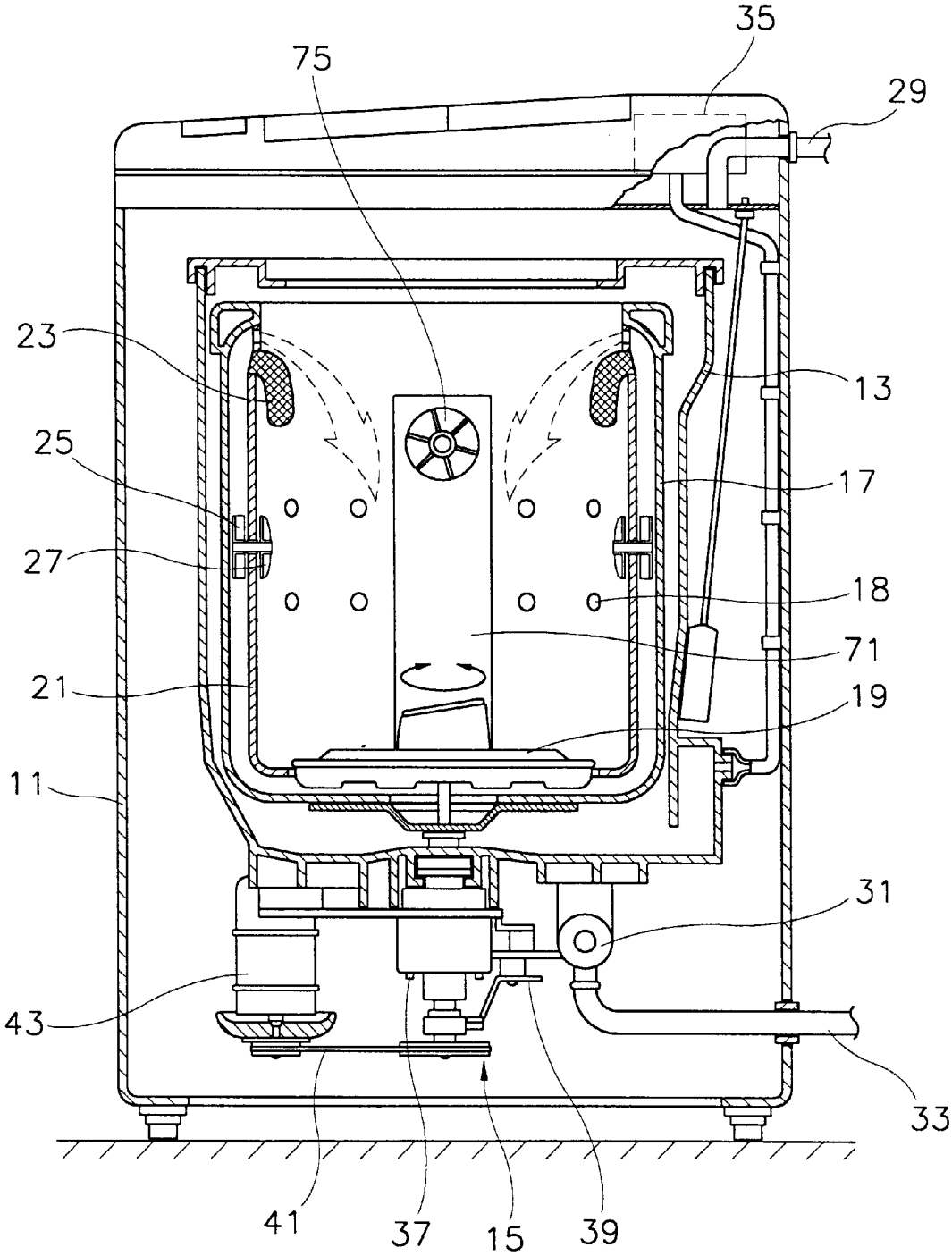
FIG. 5 is a longitudinal sectional view for illustrating a washing machine having a sub-pulsator according to a second embodiment of the present invention.

FIG. 5 is a longitudinal sectional view for illustrating a washing machine having a sub-pulsator according to a second embodiment of the present invention. In the drawing, like reference numerals are used for designation of like or equivalent parts or portions as in FIGS. 1 through 4 for simplicity of illustration and explanation, and redundant references will be omitted.

In the second embodiment, another guide duct 71 is equipped at an approximate 90 degrees from the guide duct 21 in FIG. 2 toward a peripheral direction, and the guide duct 71 is closed at a top side thereof. The guide duct 71 is disposed at an upper inner side thereof with a hydraulic turbine 73 which is rotated by the washing water which is inwardly raised. The hydraulic turbine 73 is coupled to a sub-pulsator 75 which is protruded toward the wash/spin-dry tub 17.

Figure 6:
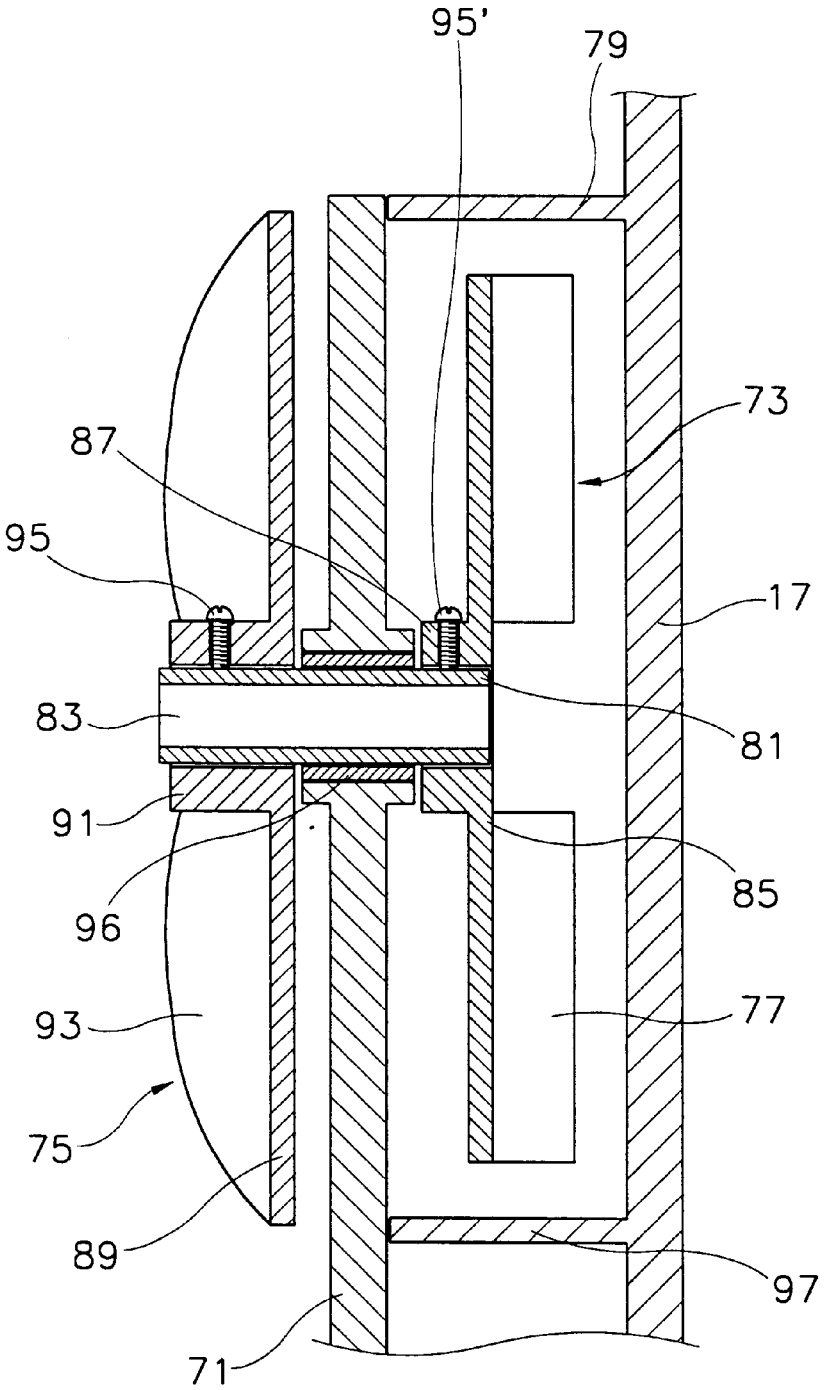
FIG. 6 is a longitudinal sectional view for illustrating a sub-pulsator in FIG. 5 and a hydraulic turbine coupled thereto.
Figure 7:
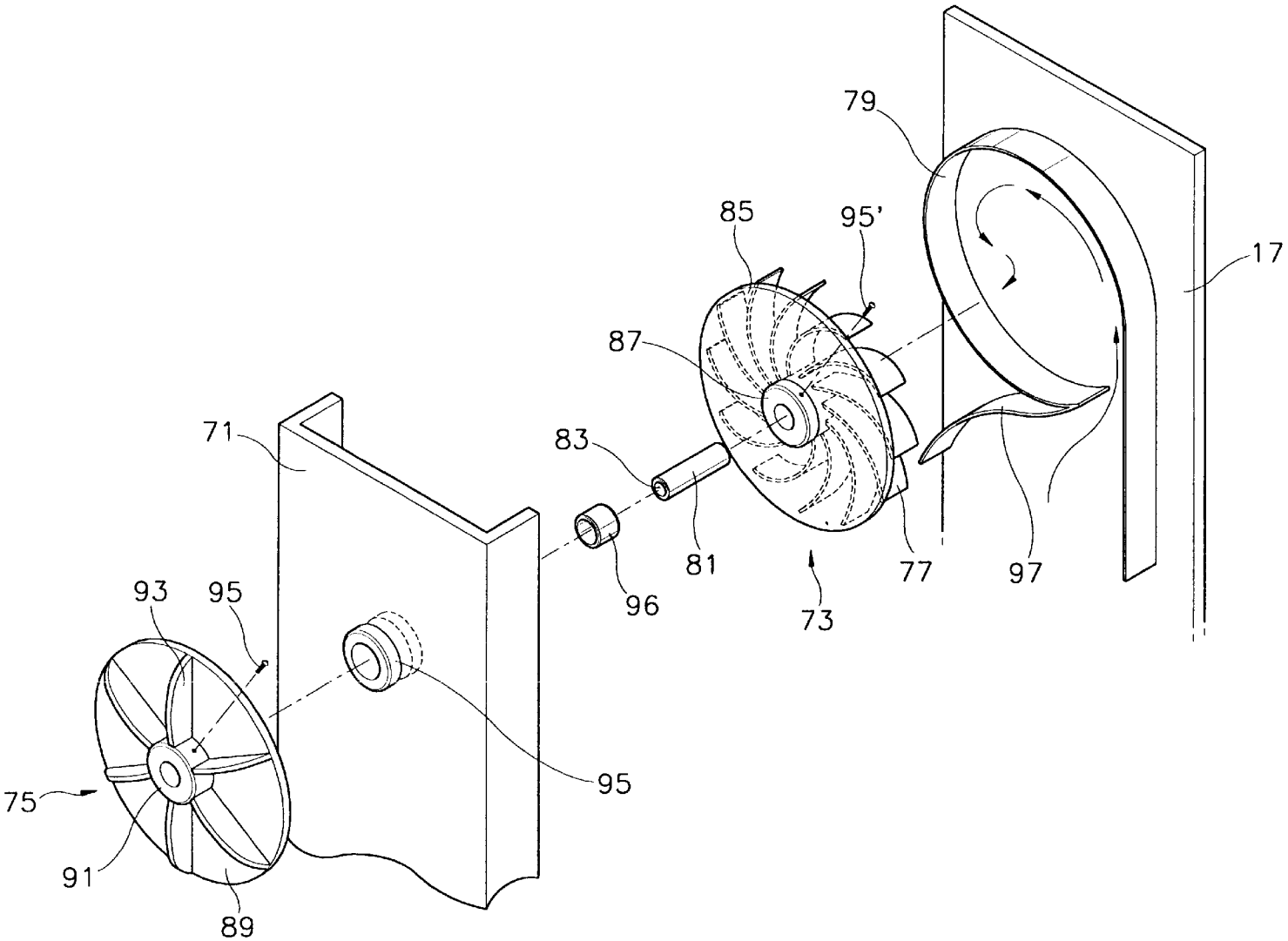
FIG. 7 is an exploded perspective view of FIG. 6.

In other words, as illustrated in FIGS. 6 and 7, the hydraulic turbine 73 is provided with vanes 77, each so arranged as to depict a shape of curvature having a radius gradually enlarged as it is distanced from the center of the hydraulic turbine 73.

Each vane 77 is equipped at an outer side thereof with a guide rib 79 for encompassing the entire vane in order to rotate the hydraulic turbine according to counteraction of the washing water hitting the vane 77. The guide rib 79 is coupled to an inner space between the guide duct 71 and the wash/spin-dry tub 17.

The shaft member 81 where the hydraulic turbine 73 and the sub-pulsator 75 are fixed is formed therein with a through hole 83. The washing water raised through a passage formed in the guide duct 71 is discharged into the wash/spin-dry tub 17 through the through hole 83.

The hydraulic turbine 73 is disposed with the vanes 77 formed with ribs toward an external side from the center of a disc unit 85 and the vanes are oppositely formed at the center thereof with a boss unit 87.

The sub-pulsator 75 is disposed with ribs from a boss unit 91 located at the center of the disc unit 89 toward radially external directions, to thereby form the vanes 93.

Both ends of a shaft member 81 through which the guide duct 71 pierces are inserted by the boss units 87 and 91 to fix the hydraulic turbine 73 and the sub-pulsator 75 by way of fastening members 95 and 95'.

The guide duct 71 is formed with a protruder 95 in order to enlarge a slippage area of the shaft member 81, and the protruder 95 is provided therein with a bush 96 in order to smooth rotation of the shaft member 81. The guide rib 79 is coupled thereunder with a lower guide rib 97 for guiding the washing water thereinto.

In a washing machine equipped with a sub-pulsator according to the second embodiment of the present invention thus constructed, the washing water riding up an inner passage of the guide duct 71 is guided by the lower guide rib 97, introduced into the guide rib 79 and rotated to rotate the vanes 77 at the hydraulic turbine 73 according to counteraction of the washing water.

Successively, the sub-pulsator 75 located within the wash/spin-dry tub 17 by being connected to the hydraulic turbine 73 is rotated to cause a water current to form within the wash/spin-dry tub 17, such that the water current of the washing machine is strengthened under the same power.

Meanwhile, the washing water which has generated the counteraction of the hydraulic turbine 73 drops into the wash/spin-dry tub through the through hole 83 centrally formed at the shaft member 71.

As apparent from the foregoing, there is an advantage in the washing machine having a sub-pulsator according to the present invention thus constructed in that power for causing a rising water current to form in a guide duct rotates a hydraulic turbine and turning effect generated from the rotation of the hydraulic turbine puts the sub-pulsation into motion to cause a water current to form in the wash/spin-dry tub, such that the power is effectively utilized and the washing is also effectively realized by an appropriate strength of water current formed at an upper side of the wash/spin-dry tub according to the sub-pulsator.

What is claimed is:

1. A washing machine, comprising:

a wash/spin-dry tub for washing and spin-drying laundry, said wash/spin-dry tub having an inner wall and inner floor;

a pulsator mounted on the inner floor of said wash/spin-dry tub, said pulsator being rotatable in the forward and reverse directions;

a guide duct formed along the inner wall of the wash/spin-dry tub, said guide duct having a bottom opening and a top opening, the bottom opening of said guide duct being near said pulsator, and the top opening of said guide duct being at an upper portion of said inner wall, said guide duct for guiding water upward from the pulsator;

a sub-pulsator mounted on said guide duct and protruding into the wash/spin-dry tub;

a hydraulic turbine mounted inside said guide duct and axially connected to said sub-pulsator, for rotating said sub-pulsator, said hydraulic turbine comprising:

a turbine disc;

a shaft axially connecting said turbine disc to said sub-pulsator;

vanes radially arranged on said turbine disc; and a guide rib mounted in the guide duct around said turbine disc, said guide rib having an opening for exposing the vanes of the turbine disc to the flow of water in the guide duct.

2. The washing machine of claim 1, said sub-pulsator further comprising:

a sub-pulsator disc; and vanes radially arranged on said sub-pulsator disc.

3. The washing machine of claim 1, further comprising:

a lower guide rib formed in the guide duct under said guide rib, for guiding water to the opening in said guide rib.

4. The washing machine of claim 3, further comprising:

an upper guide rib formed in the guide duct above said guide rib, for guiding water past the opening in said guide rib.

5. The washing machine of claim 1, further comprising:

a filtering net coupled to the top opening of said guide duct, for filtering laundry residue in wash water from the guide duct.

6. A washing machine, comprising:

a wash/spin-dry tub for washing and spin-drying laundry, said wash/spin-dry tub having an inner wall and inner floor;

a pulsator mounted on the inner floor of said wash/spin-dry tub, said pulsator being rotatable in the forward and reverse directions;

a guide duct formed along the inner wall of the wash/spin-dry tub, said guide duct having a bottom opening near said pulsator, and the top of said guide duct being closed, said guide duct for guiding water upward from the pulsator;

a sub-pulsator mounted on said guide duct and protruding into said wash/spin-dry tub, said sub-pulsator comprising:

a sub-pulsator disc having a through hole in the center of the disc; and vanes radially arranged on one side of the sub-pulsator disc;

a hollow shaft member mounted axially in the through hole of said sub-pulsator disc and penetrating into said guide duct, for rotating the sub-pulsator and conducting water through the sub-pulsator; and a hydraulic turbine mounted inside said guide duct and connected to said hollow shaft member, for rotating said sub-pulsator, said hydraulic turbine comprising:

a turbine disc having a central hole for admitting water, the central hole of the turbine disc being axially connected to said hollow shaft member;

turbine vanes arranged with rotational symmetry on said turbine disc, said turbine vanes having curvature in a cross-section parallel to the disc; and a guide rib mounted in the guide duct around said turbine disc, said guide rib having an opening for exposing the vanes of the hydraulic turbine to the flow of water in the guide duct.

7. The washing machine of claim 6, further comprising:

the curvature of said turbine vanes increasing in radius of curvature away from the center of the turbine disc.

8. The washing machine of claim 6, further comprising:

a boss formed around the center of said sub-pulsator disc, for retaining the hollow shaft member; and a boss formed around the center of said turbine disc, for retaining the hollow shaft member.

9. The washing machine of claim 6, further comprising:

a bush mounted in said guide duct, said hollow shaft member passing through said bush.

10. The washing machine of claim 6, further comprising:

a lower guide rib formed in said guide duct under said guide rib, for guiding water to the opening in said guide rib.

11. A washing machine, comprising:

a wash/spin-dry tub for washing and spin-drying laundry, said wash/spin-dry tub having an inner wall and inner floor;

a pulsator mounted on the inner floor of said wash/spin-dry tub, said pulsator being rotatable in the forward and reverse directions;

a first guide duct formed along a portion of the inner wall of the wash/spin-dry tub, said first guide duct having a bottom opening and a top opening, the bottom opening of said first guide duct being near said pulsator, and the top opening of said first guide duct being at an upper portion of said inner wall, said first guide duct for guiding water upward from the pulsator;

a sub-pulsator mounted on and near to said first guide duct;

a first hydraulic turbine axially connected to said sub-pulsator, for rotating said sub-pulsator in response to water flow in the first guide duct; and a second guide duct formed along another portion of the inner wall of the wash/spin-dry tub, said second guide duct having a bottom opening and being closed at the top;

a second sub-pulsator mounted near the second guide duct and protruding into the wash/spindry tub, said second sub-pulsator having a through hole formed centrally;

a hollow shaft member mounted axially in the through hole of said second sub-pulsator disc and penetrating into said second guide duct, for rotating the sub-pulsator and conducting water through the sub-pulsator; and a second hydraulic turbine having a central through-hole, said hollow shaft member mounted axially in the through hole of the second hydraulic turbine, said second hydraulic turbine for turning said second sub-pulsator and the through hole of said second hydraulic turbine for admitting water to said hollow shaft member.

12. The washing machine of claim 11, further comprising:

there being two of said first guide ducts oriented opposite each other in said wash/spin-dry tub; and there being two of said second guide ducts oriented approximately 90° from said first guide ducts in said wash/spin-dry tub.

13. The washing machine of claim 11, further comprising:

a first guide rib mounted in the first guide duct around the first hydraulic turbine, said first guide rib having an opening for exposing the hydraulic turbine to water flow in the guide duct.

14. The washing machine of claim 13, further comprising:

a second guide rib mounted in the second guide duct around the second hydraulic turbine.

* * * * *